United States Patent [19]

Magris et al.

[11] Patent Number: 5,042,719

[45] Date of Patent: Aug. 27, 1991

[54] OSCILLATING LAWN SPRINKLER

[75] Inventors: Erme Magris; Antonio Cadamuro; Maria Licciardello Maranzana, all of Pordenone, Italy

[73] Assignee: Uniflex Utiltime S.p.A., Pordenone, Italy

[21] Appl. No.: 507,852

[22] Filed: Apr. 12, 1990

[30] Foreign Application Priority Data

Apr. 26, 1989 [IT] Italy ..... 34017/89[U]

[51] Int. Cl.[5] ..... B05B 3/16

[52] U.S. Cl. ..... 239/242; 239/562

[58] Field of Search ..... 239/237, 242, 436, 443-447, 239/562

[56] References Cited

U.S. PATENT DOCUMENTS 2,483,719 10/1949 Anderson ..... 239/562
3,423,024 1/1969 Morawetz ..... 239/242
3,647,140 3/1972 Perrot et al. ..... 239/242

FOREIGN PATENT DOCUMENTS 3119094 11/1982 Fed. Rep. of Germany ..... 239/242

*Primary Examiner*—Andres Kashnikow
*Assistant Examiner*—Karen B. Merritt
*Attorney, Agent, or Firm*—Wenderoth, Lind & Ponack

[57] ABSTRACT

An oscillating lawn sprinkler includes a watering pipe provided with spray nozzles and a choking device for selectively limiting the watering range of the sprinkler. The choking device includes a control member, an external manual-actuation device and an internal flow-diverting element. The internal flow-diverting element is capable of being oriented, through angular displacements of the control device, in corresponding positions for diverting the flow of water coming from a water inlet opening in such a manner as to deliver the water to all of the spray nozzles in the watering pipe, or to parts of the nozzles provided in opposite length portions of the watering pipe located on opposite sides of the flow-diverting element.

14 Claims, 3 Drawing Sheets

$H_2O$
11
12
9
19
21
20
13
22
11
14
17
18
16

12
19
23
21
13
11
24
9
20
22
22
15

OSCILLATING LAWN SPRINKLER

BACKGROUND OF THE INVENTION

The present invention relates to an oscillating lawn sprinkler which is capable of being placed freely on the ground and of being connected with a water supply source and employed for irrigating tilled areas such as lawns, gardens and the like.

A sprinkler of this type basically includes a pipe having a number of differently oriented spray perforations or nozzles and pivotally mounted on a bearing block and driven to oscillate by the pressure of in-flowing water through a driving mechanism such as a turbine-type motor enclosed in a sealed box. The bearing block usually has an elongated shape and the box containing the driving mechanism is mounted at one end of the block in such a way as to be connected with the water supply source and at the same time to act as a driving support for at least one of the ends of the oscillating pipe. Mechanical control means, provided in the box containing the driving mechanism, are used to selectively define the surface of the area to be watered by setting the oscillation angle of the spray pipe accordingly. Further mechanical control means are provided inside the oscillating pipe itself for adjusting the surface of the area to be watered by blocking or choking part of the available spray nozzles, i.e. shutting off or blocking access of the water to selected of the nozzles.

German patent application No. 3,119,094 discloses a tubular sprinkler that is provided with a cylindrical slide valve that, through the use of a worm gear, i.e. wheel handle and related shank, can be caused to slide inside the spray pipe in order to choke or shut off part of its spray ports or nozzles. Such a device, however, has a major drawback in that it only enables spray nozzles to be shut off unidirectionally and in correspondence with that portion of the watering pipe in which the valve can actually be made to slide. This drawback causes an inconvenience in that the sprinkler itself must be displaced, or its orientation changed, each time special requirements arise for an area-limited watering action.

SUMMARY OF THE INVENTION

Therefore, it is a principal object of the present invention to provide a sprinkler of the above described type but including a choking device capable of supplying water to all available spray nozzles or ports along the watering pipe or of choking or shutting off portions of the nozzles in a bidirectional manner with respect to or along the longitudinal axis of the watering pipe, i.e. of supplying water to nozzles ports along either of opposite end or half portions of the length of the pipe.

It is a further object of the present invention to provide an assembly for use in an oscillating water sprinkler of the above type, and including a choking device as indicated above.

These objects are achieved in accordance with the present invention by the provision that the choking device includes control means having a cross-sectional size which is smaller than the inner bore of the watering pipe, an external manual-actuation means connected to the control means and having sealing means for sealing with the watering pipe, and internal flow-diverting means connected to the control means and having sealing means for sealing with the watering pipe. The flow-diverting means is movable to appropriate positions, in response to corresponding angular displacements of the control means by the external manual-actuation means, to divert the flow of water coming from an inlet opening into the interior of the watering pipe in such a way as to deliver the water either to all of the spray nozzles of the watering pipe or to only parts of the spray nozzles located along length portions of the watering pipe on opposite sides of the flow-diverting means.

In accordance with one feature of the present invention, the flow-diverting means is movable to either of two choking positions to deviate the entire water flow from the water inlet opening and to a position to subdivide the inlet opening into two half-openings.

In accordance with a still further feature of the present invention, the water inlet opening is provided in the watering pipe within an area defined by contact surfaces between the sealing means of the flow-diverting means and the inner surface of the watering pipe.

In accordance with an even further feature of the present invention, the control means comprises a cylindrical stem defining an annular flow channel with the inner surface of the watering pipe, the external manual-actuation means comprises an outer end of the stem shaped as a handle, and the internal flow-diverting means comprises an inner end of the stem shaped as an oblique wall. The sealing means comprise ring-shaped seals between the inner surface of the watering pipe and the outer surface of the stem. The oblique wall is inclined, for example at a 45 degree angle with respect to the longitudinal axis of the watering pipe. The oblique wall is positioned above the inlet opening and is capable of taking, when the stem is rotated sequentially by 90 degree increments, corresponding positions for diverting the entire flow of water toward the spray nozzles located along that portion of the length of the watering pipe which is opposite to that length portion thereof housing the choking device, toward all of the spray nozzles provided in the watering pipe, or toward those spray nozzles that are located along that length portion of the watering pipe defining the annular outflow channel.

BRIEF DESCRIPTION OF THE DRAWINGS

Other objects, features and advantages of the invention will become more apparent from the following description by way of non-limiting example with reference to the accompanying drawings, in which.

DETAILED DESCRIPTION OF THE INVENTION

Figure 1:
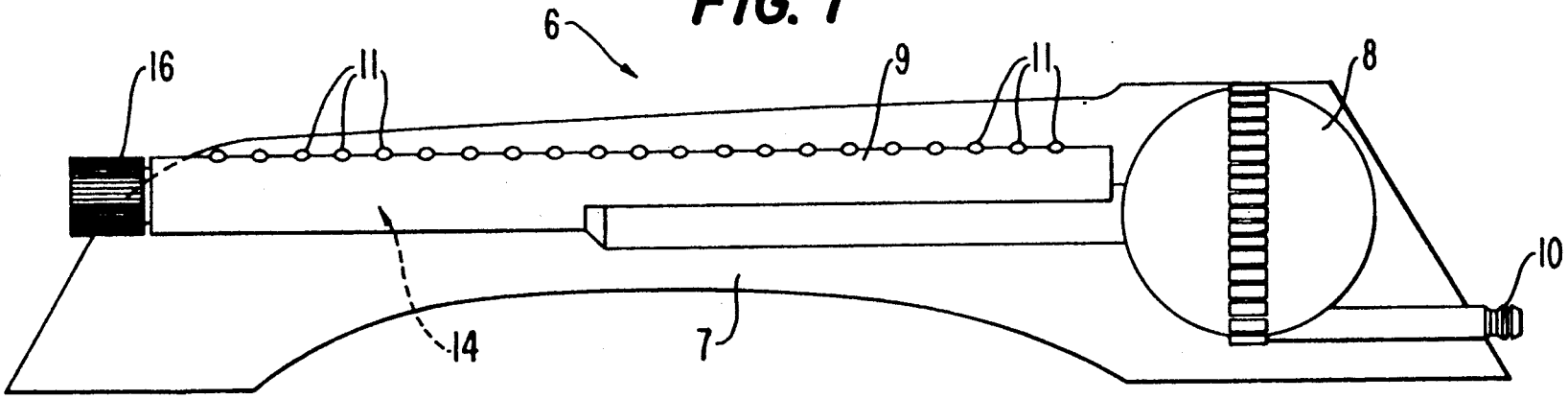
FIG. 1 is a side elevation view of a sprinkler according to the invention.

The sprinkler 6 shown in the drawings includes a bearing block 7 which supports both a driving mechanism box 8 and an oscillating watering pipe 9.

The driving mechanism box 8 is of a traditional water-pressure type and includes all conventional components as required to operate the watering pipe 9 for oscillation (e.g. a turbine-like motor, a mechanism to adjust the oscillating range of the watering pipe 9, etc.), all of which are already well-known and therefore do not require further description. It should be sufficient here to remember that the sprinkler 6 is operated by the pressure that the water flowing into the driving mechanism box 8 from its supply source through an inlet connection 10 imparts to blades of a turbine-like motor that is mechanically linked to the watering pipe 9. Apart from the aforementioned device for the adjustment of the oscillation range of the watering pipe 9, the driving mechanism box 8 further contains a device of well-known type, and therefore not shown in the drawings, which is intended to adjust the flow rate of the water delivered by the sprinkler 6 itself.

The watering pipe 9 is provided on its upper portion with a plurality of spray nozzles 11, all of which have different inclinations with respect to the longitudinal axis of the watering pipe 9. The nozzles 11 are supplied with water through a conduit 12 leading from the driving mechanism box 8 and communicating with the watering pipe 9 through an opening 13 having a shape which is elongated transversely with respect to the watering pipe 9 (FIG. 3) and located at a position which is nearly central with respect to the longitudinal axis of the watering pipe 9.

Figure 2:
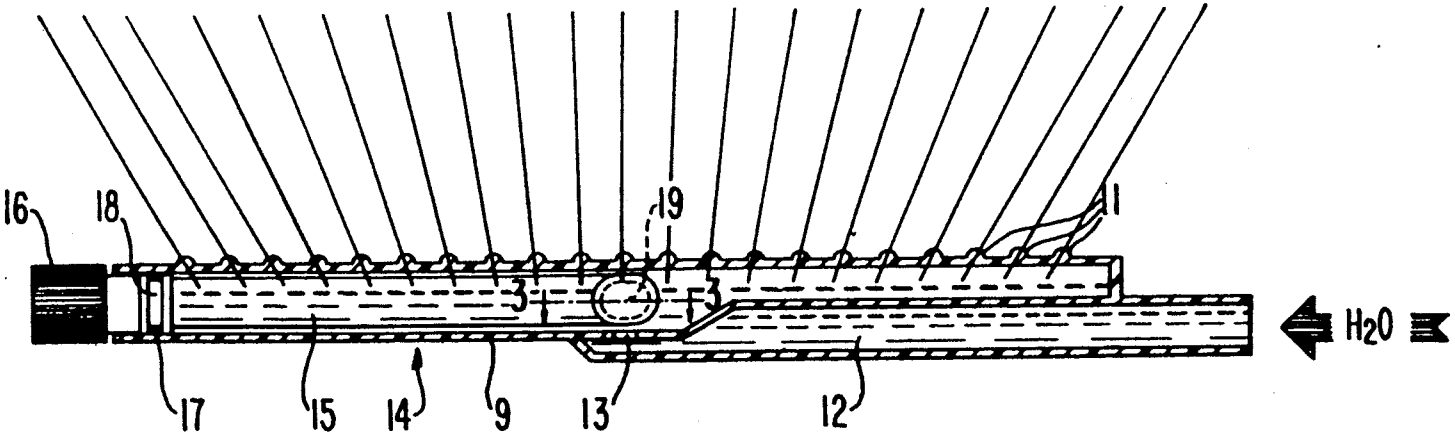
FIG. 2 is a longitudinal vertical sectional view of a watering pipe of such sprinkler, shown set for watering the largest possible surface area.
Figure 3:
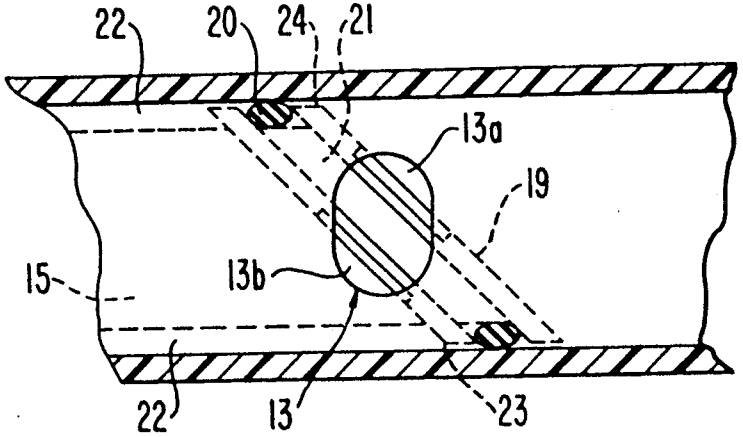
FIG. 3 is an enlarged partial longitudinal sectional view taken along line 3—3 of FIG. 2.
Figure 4:
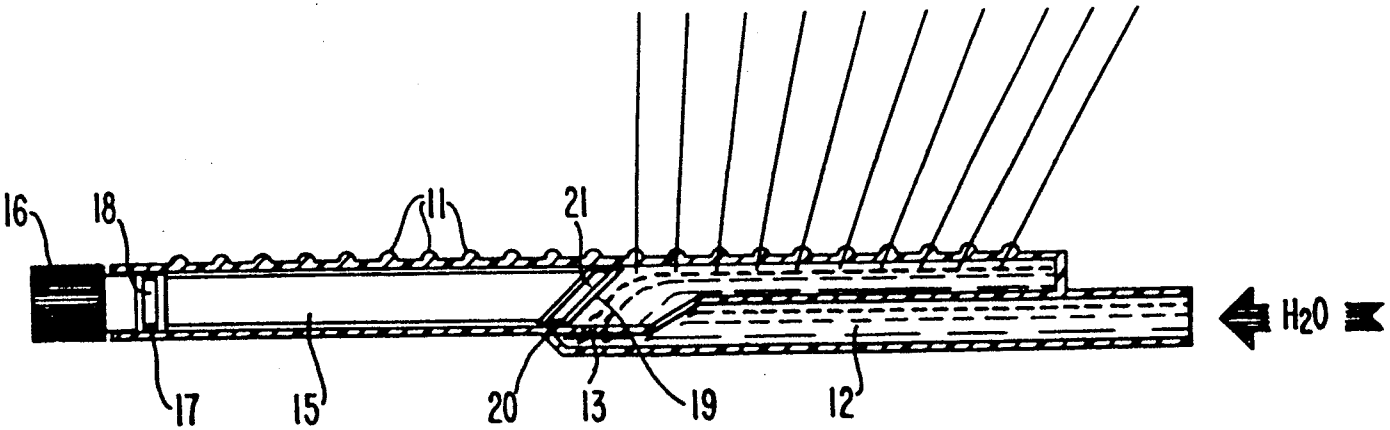
FIGS. 4 and 5 are views similar to FIG. 2, but showing the watering pipe set for ensuring two different types of partially choked watering actions.
Figure 5:
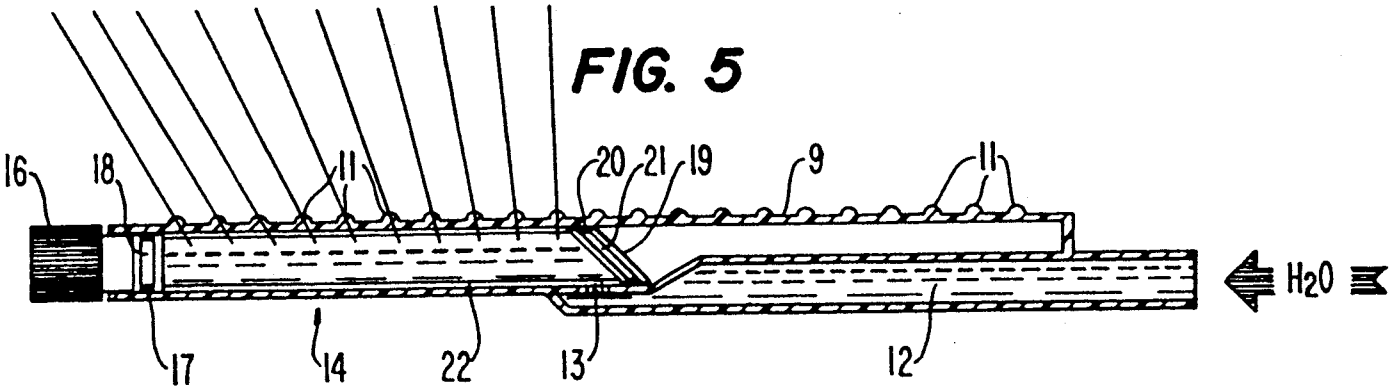

A choking device 14 for selectively limiting the longitudinal extent of the surface area to be watered is rotatably housed in a watertight sealed manner in that end of the watering pipe 9 which is opposite to the end thereof connected with the driving mechanism box 8. Such choking device essentially is formed by a cylindrical stem 15 having a cross-sectional size which is smaller than the inner bore of the watering pipe 9, thereby defining with the inner surface of the watering pipe 9 an annular outflow space 22 (FIGS. 3, 5). The outer end of stem 15 is provided with a control handle 16 to enable rotational adjustment of stem 15 relative to pipe 9. A sealing ring 17 is snapped into a circumferential seat 18 and seals against the inner surface of pipe 9 (FIGS. 2, 4, 5).

Figure 6:
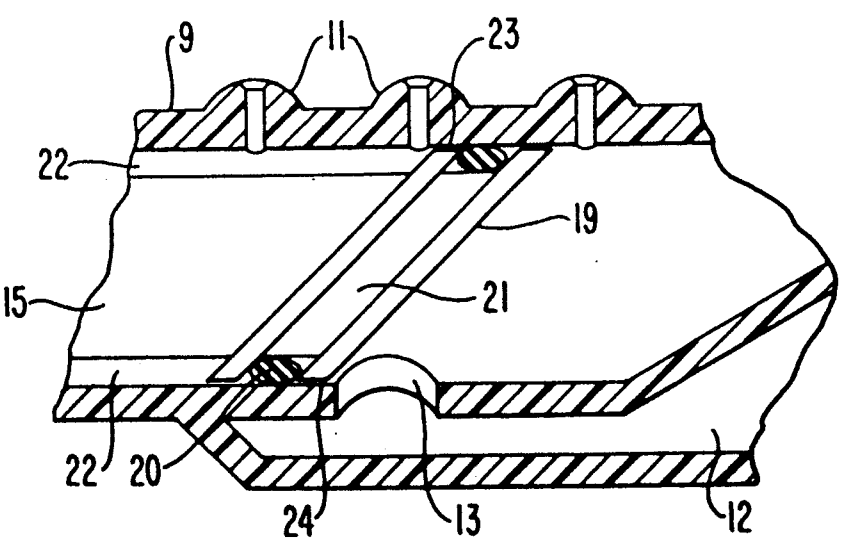
FIG. 6 is an enlarged partial longitudinal sectional view showing a particular feature of FIG. 4.

The inner end of stem 15 is terminated by a wall 19 which is oriented obliquely with respect to the longitudinal axis of the watering pipe 9 and which also is provided with a circumferential sealing ring 20 fitted within a housing seat 21 to seal against the inner surface of pipe 9 (FIGS. 3, 6). The inclination angle of oblique wall 19 is selected in such a way as to ensure that the width of the water supply opening 13 at all times is positioned within a space formed between an inner acute angle corner 23 and an outer obtuse angle corner 24 of the seat 21 of the sealing ring 20 (FIGS. 3 and 6). In the particular embodiment shown in the drawings, wall 19 is inclined by an angle of 45 degrees with respect to the longitudinal axis of the watering pipe 9.

By rotating the control handle 16, and hence the stem 15, by selected increments, e.g. 90 degree increments, the wall 19 can be oriented in selected positions, e.g. in a position to enable all of the available spray nozzles 11 to be supplied with water for watering purposes (FIGS. 2 and 3), or in positions to cause the incoming water flow to be diverted toward the spray nozzles 11 located on the right side with respect to the water supply opening 13 (FIGS. 4 and 6) or toward the spray nozzles 11 located on the left side with respect to the water supply opening 13 (FIG. 5).

In particular, when the wall 19 is oriented in its position for maximum watering range (FIGS. 2 and 3), the water supply opening 13 practically is subdivided into two arc-shaped openings 13*a*, 13*b* (FIG. 3) which deliver the water to the right-hand and left-hand portions of the watering pipe 9, respectively.

When the wall 19 is oriented as shown in FIGS. 4 and 6 or in FIG. 5, all of the incoming water flow is diverted so that it will reach, respectively, the spray nozzles 11 located along the right-hand portion of the watering pipe 9, or the spray nozzles located along the left-hand portion of the watering pipe 9 via the annular outflow space 22. It should be noticed in this connection that annular outflow space 22 is lengthwise delimited by the two sealing rings 17 and 20.

With the sprinkler and the related control devices according to the above description, the objects of the invention can be achieved fully by the provision of a choking device capable of enabling the supply of water to all of the available spray nozzles 11 provided along the watering pipe 9, as well as capable of selectively shutting off or blocking the supply of water to selected of the spray nozzles 11 in a bidirectional manner with respect to the longitudinal axis of the watering pipe 9.

It will of course be appreciated that the above described sprinkler and its choking device may also be the subject of any such modifications as considered to be appropriate, without departing from the scope of the invention as claimed hereinafter. For instance, the flow diverting wall 19 may be given different shapes or inclinations, while the cylindrical stem 15 may be provided with, or made to appropriately cooperate with, special ports and/or recesses, or may further be replaced with one or more stems connecting the control handle 16 with the wall 19.

We claim:

1. In an oscillating sprinkler comprising a bearing block, a watering pipe having a water inlet opening and spray nozzles and pivotally mounted on said bearing block so that it is capable of oscillating around a longitudinal axis, a water pressure actuated driving mechanism housed in a watertight box connected to a first end of said watering pipe and to be connected to a water supply source for driving said watering pipe oscillatingly about said axis according to an angle and a water flow rate adjustable by an adjustment means associated with said driving mechanism box, a choking device to selectively limit the watering range of said sprinkler, said choking device being housed in a movable manner within a second end of said watering pipe for cooperation with said water inlet opening, the improvement comprising:

said choking device including a control means having a cross-sectional size which is smaller than the inner bore of said watering pipe, such that water from said water inlet opening is flowable between said watering pipe and said control means;

external manual-actuation means connected to said control means and having sealing means for sealing with said watering pipe;

internal flow-diverting means connected to said control means and having sealing means for sealing with said watering pipe; and said flow-diverting means being movable to appropriate positions, in response to corresponding angular displacements of said control means by said external manual-actuation means, to divert the flow of water coming from said opening in such a way as to deliver it either to all of said spray nozzles of said watering pipe or to only parts of said spray nozzles located along length portions of said watering pipe on opposite sides of said flow-diverting means.

2. The improvement claimed in claim 1, wherein said flow-diverting means is movable to either of two choking positions to deviate the entire water flow from said water inlet opening, and to a position to subdivide said opening into two half-openings.

3. The improvement claimed in claim 1, wherein said water inlet opening is provided in said watering pipe within an area defined by contact surfaces between said sealing means of said flow-diverting means and the inner surface of said watering pipe.

4. The improvement claimed in claim 1, wherein said control means comprises a cylindrical stem defining an annular outflow channel with the inner surface of said watering pipe, said external manual-actuation means comprises an outer end of said stem shaped as a handle, and said internal flow-diverting means comprises an inner end of said stem shaped as an oblique wall, said sealing means comprises ring-shaped seals means between said inner surface of said watering pipe and the outer surface of said stem, said oblique wall is inclined with respect to said longitudinal axis of said watering pipe, said oblique wall is positioned above said opening and capable of taking, when said stem is rotated sequentially by increments, corresponding positions for diverting the entire flow of water toward those said spray nozzles located along that portion of the length of said watering pipe which is opposite to that length portion thereof housing said choking device, toward all of said spray nozzles provided in said watering pipe, or toward those said spray nozzles that are located along that length portion of said watering pipe defining said annular outflow channel.

5. The improvement claimed in claim 4, wherein said oblique wall is inclined at an angle of 45° to said longitudinal axis.

6. The improvement claimed in claim 4, wherein said stem is rotatable about said longitudinal axis by 90° increments.

7. The improvement claimed in claim 1, wherein said control means has a structure to prevent water from said water inlet opening from flowing internally and through said control means.

8. An assembly for use in an oscillating water sprinkler, said assembly comprising:

a longitudinal watering pipe adapted to be mounted for oscillation on a bearing block of a water sprinkler, said watering pipe having an inner bore defining an interior and a water inlet opening for the introduction of water into said interior of said water pipe, and said watering pipe having spaced longitudinally thereof a plurality of nozzles for spraying water from said interior;

control means extending into an end of said watering pipe and housed in said interior, said control means having a cross-sectional size smaller than said inner bore of said watering pipe, such that water from said water inlet opening is flowable between said watering pipe and said control means;

external manual-actuation means connected to said control means for rotating said control means relative to said water pipe and having sealing means for sealing with said watering pipe; and internal flow-diverting means, connected to said control means and having sealing means for sealing with said watering pipe, for, upon corresponding angular displacement of said control means by said manual-actuation means, moving relative to said inlet opening to respective positions to allow delivery of water to all of said nozzles or to only parts of said nozzles located along length portions of said watering pipe on opposite sides of said flow-diverting means.

9. An assembly as claimed in claim 8, wherein said low-diverting means is movable to either of two choking positions to deviate the entire water flow from said water inlet opening, and to a position to subdivide said opening into two half-openings.

10. An assembly as claimed in claim 8, wherein said water inlet opening is provided in said watering pipe within an area defined by contact surfaces between said sealing means of said flow-diverting means and the inner surface of said watering pipe.

11. An assembly as claimed in claim 8, wherein said control means comprises a cylindrical stem defining an annular outflow channel with the inner surface of said watering pipe, said external manual-actuation means comprises an outer end of said stem shaped as a handle, and said internal flow-diverting means comprises an inner end of said stem shaped as an oblique wall, said sealing means comprises ring-shaped seals means between said inner surface of said watering pipe and the outer surface of said stem, said oblique wall is inclined with respect to said longitudinal axis of said watering pipe, said oblique wall is positioned above said opening and capable of taking, when said stem is rotated sequentially by increments, corresponding positions for diverting the entire flow of water toward those said spray nozzles located along that portion of the length of said watering pipe which is opposite to that length portion thereof housing said choking device, toward all of said spray nozzles provided in said watering pipe, or toward those said spray nozzles that are located along that length portion of said watering pipe defining said annular outflow channel.

12. An assembly as claimed in claim 11, wherein said oblique wall is inclined at an angle of 45° to said longitudinal axis.

13. An assembly as claimed in claim 11, wherein said stem is rotatable about said longitudinal axis by 90° increments.

14. An assembly as claimed in claim 8, wherein said control means has a structure to prevent water from said water inlet opening from flowing internally and through said control means.

* * * * *